US007508949B2

(12) United States Patent
Neilson

(10) Patent No.: US 7,508,949 B2
(45) Date of Patent: Mar. 24, 2009

(54) FACE PLATE CONNECTOR FOR HEARING AID

(75) Inventor: Mark A. Neilson, Zimmerman, MN (US)

(73) Assignee: In'Tech Industries, Inc., Ramsey, MN (US)

( * ) Notice: Subject to any disclaimer, the term of this patent is extended or adjusted under 35 U.S.C. 154(b) by 800 days.

(21) Appl. No.: 11/092,243

(22) Filed: Mar. 29, 2005

(65) Prior Publication Data

US 2006/0078142 A1 Apr. 13, 2006

Related U.S. Application Data

(60) Provisional application No. 60/618,071, filed on Oct. 12, 2004.

(51) Int. Cl.
*H04R 25/00* (2006.01)

(52) U.S. Cl. ..... 381/314; 381/323

(58) Field of Classification Search ..... 381/322, 381/323, 324

See application file for complete search history.

(56) References Cited

U.S. PATENT DOCUMENTS

| | | | | |
|---|---|---|---|---|
| 5,188,540 | A | 2/1993 | Haertl et al. | |
| 5,799,095 | A | 8/1998 | Hanright | |
| 5,915,031 | A * | 6/1999 | Hanright | 381/323 |
| 6,035,050 | A | 3/2000 | Weinfurtner et al. | |
| 6,044,164 | A | 3/2000 | Ach-Kowalewski | |
| 6,088,339 | A | 7/2000 | Meyer | |
| 6,556,686 | B1 | 4/2003 | Weidner | |
| 6,678,386 | B2 * | 1/2004 | Robinson et al. | 381/323 |
| 6,985,598 | B1 * | 1/2006 | Joschika | 381/323 |
| 2004/0052390 | A1 * | 3/2004 | Morales et al. | 381/323 |
| 2004/0120540 | A1 | 6/2004 | Mullenborn et al. | |

FOREIGN PATENT DOCUMENTS

EP 1077587 A2 2/2001

OTHER PUBLICATIONS

Henkel Technologies, "Rigid Molding Process" catalog p., Mar. 2004.

* cited by examiner

*Primary Examiner*—Walter F Briney, III
(74) *Attorney, Agent, or Firm*—Brooks, Cameron & Huebsch, PLLC

(57) ABSTRACT

A hearing aid programming system includes a hearing aid housing; a faceplate attached to the hearing aid housing with an opening for receiving a battery door and also having an outside surface; programming terminals located in the opening immediately adjacent the outside surface of the faceplate; a battery door located within the opening. One edge of the battery door and the opening form a slot. The battery door is hinged to the faceplate and is movable between an open position and a closed position. A flexible programming strip having electrodes is dimensioned to fit within the slot. The electrodes mate with the programming terminals. The battery door hinge in the closed position presses the electrodes against the programming terminals to make electrical contact.

8 Claims, 5 Drawing Sheets

FACE PLATE CONNECTOR FOR HEARING AID

This application is a continuation of application Ser. No. 60/618,071, filed Oct. 12, 2004, entitled "FACE PLATE CONNECTOR FOR A HEARING AID"

BACKGROUND OF THE INVENTION

The invention relates to hearing aids, and more particularly relates to programmable hearing aids. In its most immediate sense, the invention relates to apparatus used to make an electrical connection between a programmable hearing aid and the programming unit used to program it.

A programmable hearing aid is a hearing aid in which certain characteristics of the aid (e.g. frequency response, attack and release times, AGC etc.) are adjustable by the hearing aid dispenser. Conventionally, such aids are programmed in situ, i.e. while they are in the patient's ear. This permits the patient and dispenser to check on the programming of the aid and to adjust the programming if the performance of the aid is substandard. In some classes of programmable hearing aids, the aid is programmed by plugging a male portion of a connector into a corresponding female portion that is mounted to the faceplate of the hearing aid.

Such a connector is highly undesirable when used on small hearing aids such as CIC (completely-in-canal) aids. This is because CIC aids vary in size and shape; the housing of each CIC aid is custom molded to the shape of the patient's ear. With such variations in size and shape, there is no guarantee that the faceplate will have room for the connector or that the other faceplate-mounted components can be appropriately located on the faceplate if the connector is provided. By way of example, the faceplate of a hearing aid must provide room for a microphone port, a vent opening, a battery door and a retrieval line. Furthermore, the location of these elements is not a mere matter of choice: the microphone port should be located as far as possible from the vent opening to prevent feedback, and the battery door must be so located that it can be opened and closed.

Furthermore, the female connector is difficult to install and to use. The female connector is difficult to install because it must be properly oriented with respect to the faceplate. This in turn comes about because the mating male connector often has a 45 degree bend. If the female connector is not properly oriented with respect to the faceplate, the male connector will, during use, press against the interior of the user's ear. It is likewise difficult to use the female connector, because the male connector must be properly aligned for a connection to be established and the small sizes of the connectors makes it difficult to see whether the alignment between them is in fact proper. If the alignment is incorrect, it is relatively easy to damage the male connector, the female connector or both while trying to make an electrical connection between them.

Additionally, because the location of the female connector cannot be predicted in advance of the manufacturing process, production personnel must be capable of deciding e.g. a) whether there is enough room for the female connector on the faceplate, b) where the female connector should be located with respect to the other components that must be mounted on the faceplate, and c) the best way to wire the connector to the circuitry inside the aid. It is consequently necessary to employ highly skilled individuals to assemble the aid.

U.S. Pat. No. 4,961,230 relates to a programming system whereby the electrical connections necessary to program the aid are accessed through the door of the aid, thereby eliminating the need for a faceplate-mounted female connector. In this system, the dispenser removes the battery from the aid and inserts a programming "pill" that fits in the battery compartment. The dispenser then closes the door, places the aid in the user's ear, and programs the aid in situ.

While this system does away with the need for a female connector on the faceplate of the aid, it introduces disadvantages of its own. One such disadvantage is caused by the requirement that the cable connecting the programming pill with the programming unit be relatively thick.

In the system disclosed in U.S. Pat. No. 4,961,230 the battery is removed during the programming operation and power must be supplied through the cable. For this reason, and because modern hearing aids have many programmable functions, a cable for programming a modern CIC aid must contain four electrical conductors and the cable must be shielded against noise. Additionally, the cable must be mechanically robust to have the necessary durability, and for this reason also the cable must have a certain thickness. Because the cable is required to be relatively thick and because the cable must be able to exit the battery compartment with the battery door closed, the battery door cannot fit closely to the faceplate; sufficient clearance must exist so the cable can get out.

A loosely-fitting battery door is not only aesthetically unsatisfactory, but also seriously degrades the performance of the aid. This is because the opening between the door and the faceplate establishes an acoustic coupling with the microphone. This causes feedback.

This known system has other disadvantages as well. Because the programming pill and the cable are relatively bulky, they change the aural characteristics of the patient's outer ear. As a result, the patient's unaided hearing during programming of the aid is different from the patient's unaided hearing when the programming apparatus has been removed from the patient's ear. Furthermore, the power supply from the programming unit has different electrical characteristics from those of an installed battery, and the aid functions differently when powered by the programming unit.

U.S. Pat. No. 5,799,095 (herein incorporated by reference) discloses a beside-the-door programming system for programming hearing aids that purports to address the above problems. However, the '095 patent does not completely solve these problems. Because the terminals that receive the female connector are on a printed circuit board 54 within the hearing aid housing at a significant distance from the faceplate 22, there is a large arm of movement between the pivot point of the collar 66 where it abuts against the faceplate 22 and the board 54. Any slight movement of the cable 64 during programming of the hearing aid can cause the electrodes 58-63 to come loose from the circuit board 54, thus breaking the connection.

U.S. Pat. No. 6,678,386 discloses a programmable module 300 that fits into a slot 220 in the battery door opening of the hearing aid. However, because of the bulk of the module, caused by the necessity for spring connectors and fingers, and the necessity for an additional wall, the slot 220 must be made much larger than that disclosed in the '095 patent. This in turn impacts the manufacturing process and the placement of the battery door opening on the faceplate. Furthermore, the battery door must be more loosely fitting, with the disadvantages of such loose fit discussed above.

There is a need for a new hearing aid programming system that addresses the above problems.

SUMMARY OF THE INVENTION

A hearing aid programming system, comprising:

(a) a hearing aid housing;

(b) a faceplate attached to the hearing aid housing and having an opening for receiving a battery door and also having an outside surface;

(c) a plurality of programming terminals located in the opening for receiving a battery door immediately adjacent the outside surface of the faceplate;

(d) a battery door located within the opening for receiving the battery door, one edge of the battery door defining with the opening a slot, the battery door being hingedly connected to the faceplate and movable between an open position and a closed position;

(e) a flexible programming strip having a plurality of electrodes and dimensioned to fit within the slot, the plurality of electrodes mating with the plurality of programming terminals; and (f) the battery door in the closed position pressing the electrodes against the programming terminals to make electrical contact therewith.

DETAILED DESCRIPTION OF THE PREFERRED EMBODIMENT

Figure 1:
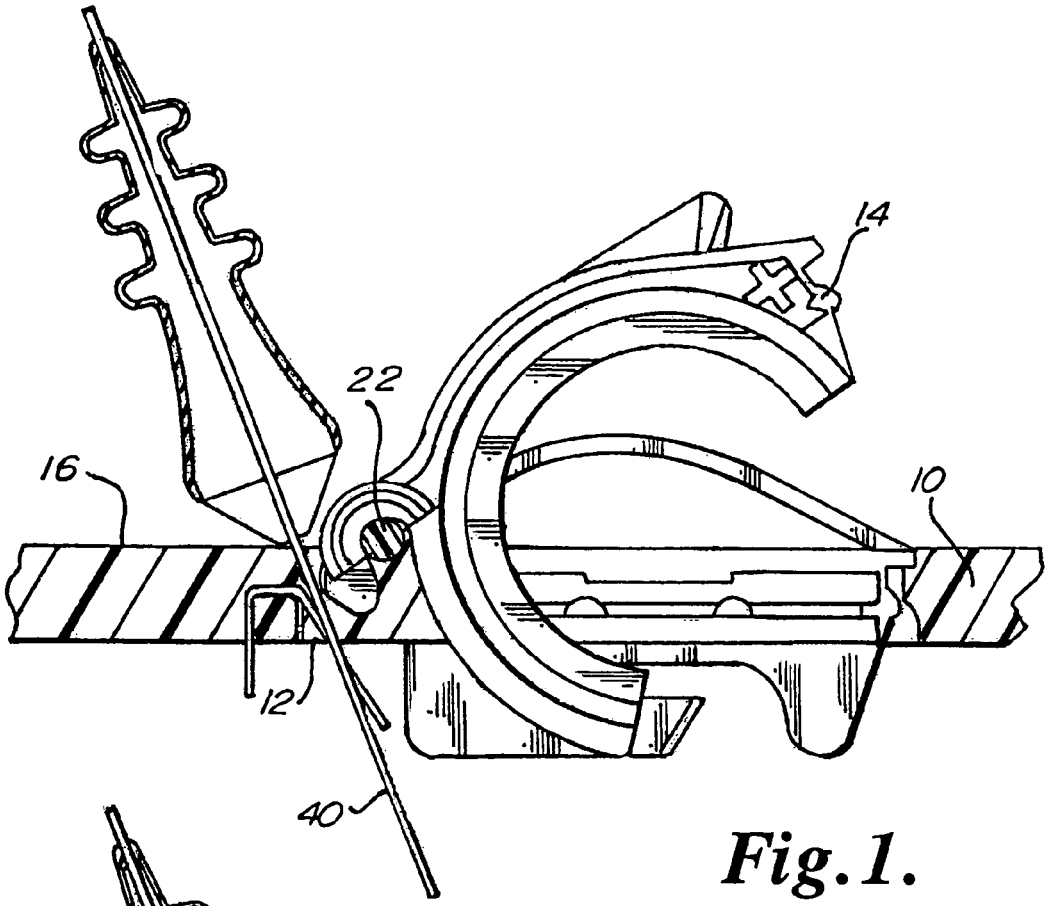
Fig. 1. PRIOR ART
FIG. 1 is a schematic of a programming system of the prior art with the battery door open.
Figure 2:
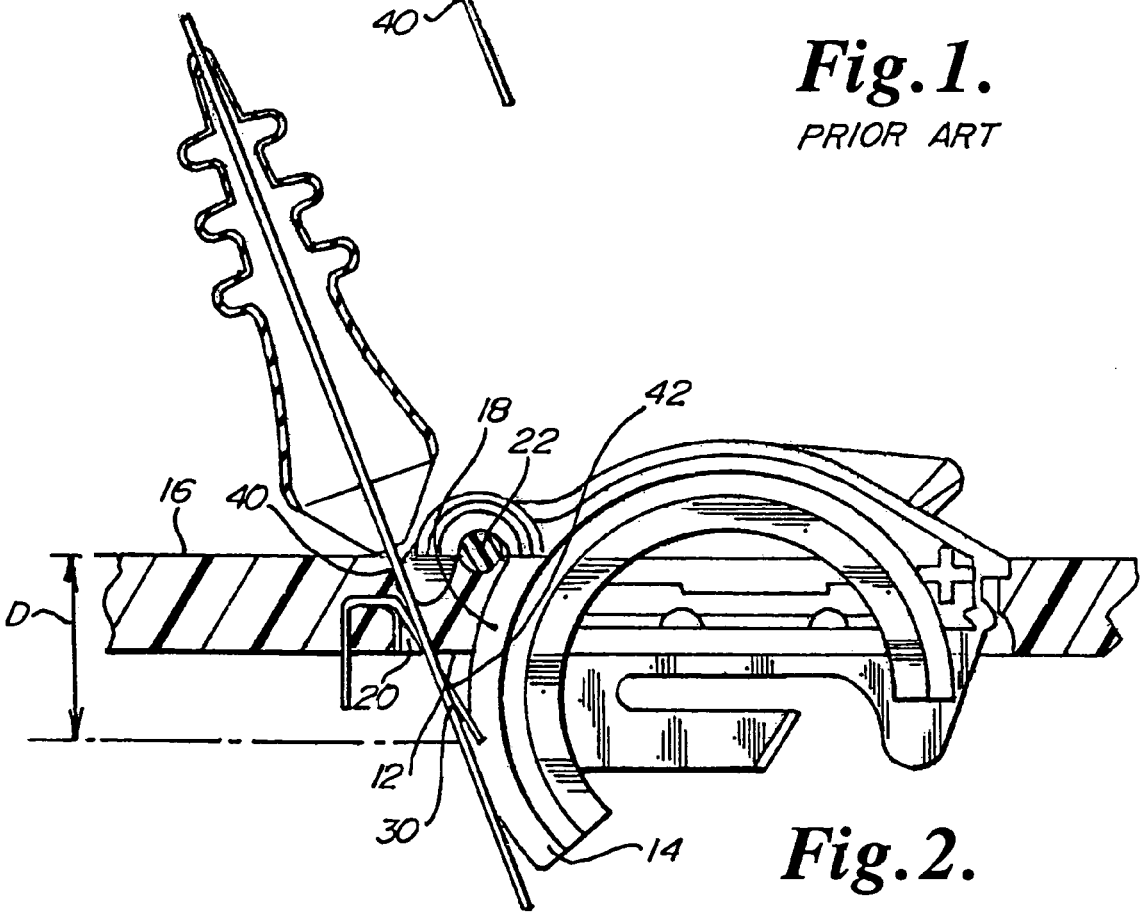
Fig. 2. PRIOR ART
FIG. 2 is similar to FIG. 1, with the battery door closed.
Figure 3:
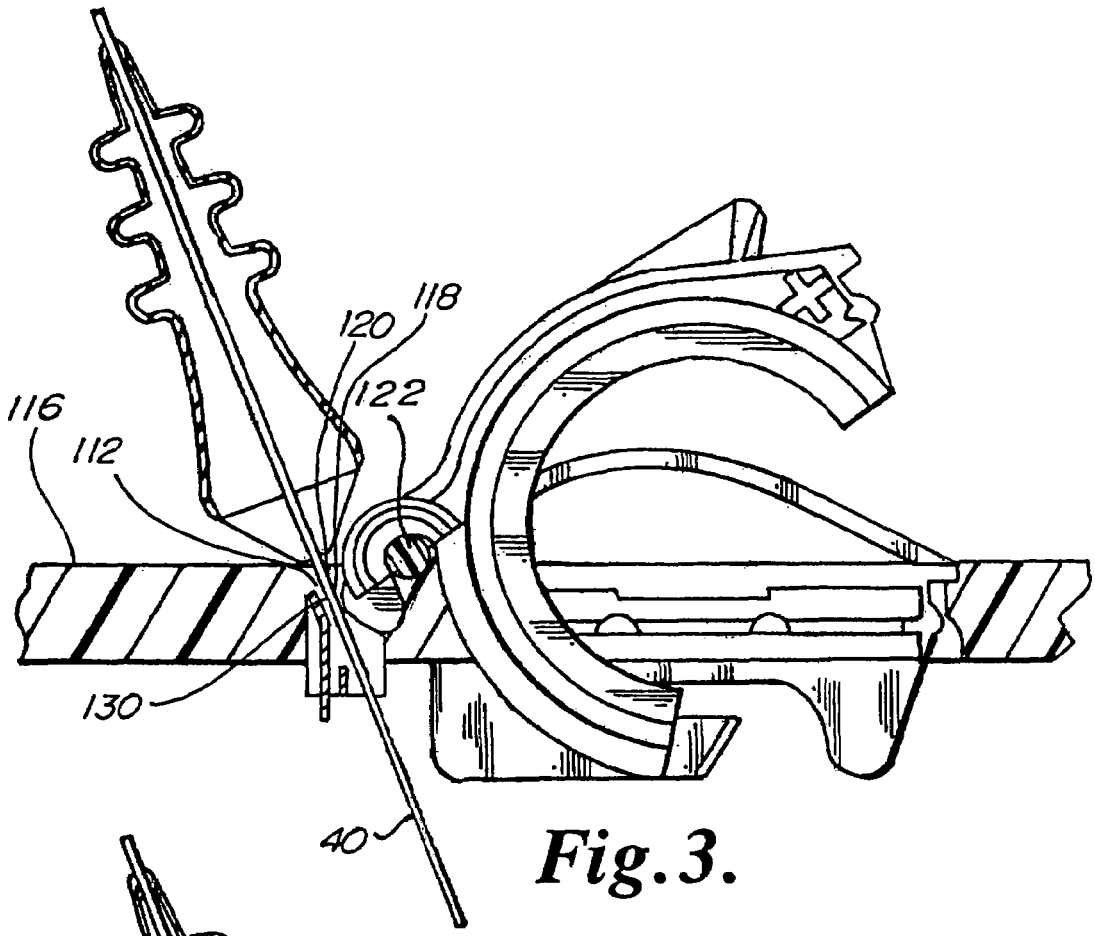
FIG. 3 is a schematic of the programming system of the present invention with the battery door open.

FIGS. 1 and 2 show a hearing aid programming system of the prior art. The prior art system has a faceplate 10. The faceplate 10 has an opening 12 for receiving a battery door 14. The faceplate 10 has an outside surface 16. The battery door 14 has an edge 18 defining a slot 20 with the opening 12 (FIG. 2). The battery door 14 is hingedly connected to the faceplate 10 by a hinge 22 and is movable between an open position (FIG. 1) and a closed position (FIG. 2). A plurality of programming terminals 30 are located in the opening 12 displaced from the outside surface 16 of the faceplate by some distance D (FIG. 2). A flexible programming strip 40 having a plurality of electrodes 42 and dimensioned to fit within the slot 20 may be inserted into the slot 20. The electrodes 42 then mate with the programming terminals 30. When the battery door 14 is closed (FIG. 2), the battery door presses the electrodes 42 against the programming terminals 30. Because of the large distance D between the point of contact of the flexible electrode strip 40 with the outside surface 16 of the faceplate 10 and the programming terminals 30, there is a large arm of movement in that portion of the flexible electrode strip 16 within the opening 12 below the outside surface 16 of the faceplate 10. Thus, any slight movement of the cable C in which the terminal strip 40 is embedded can cause the electrodes 42 to break contact with the programming terminals 30. Typically, the distance D is about 0.142 inches.

Figure 4:
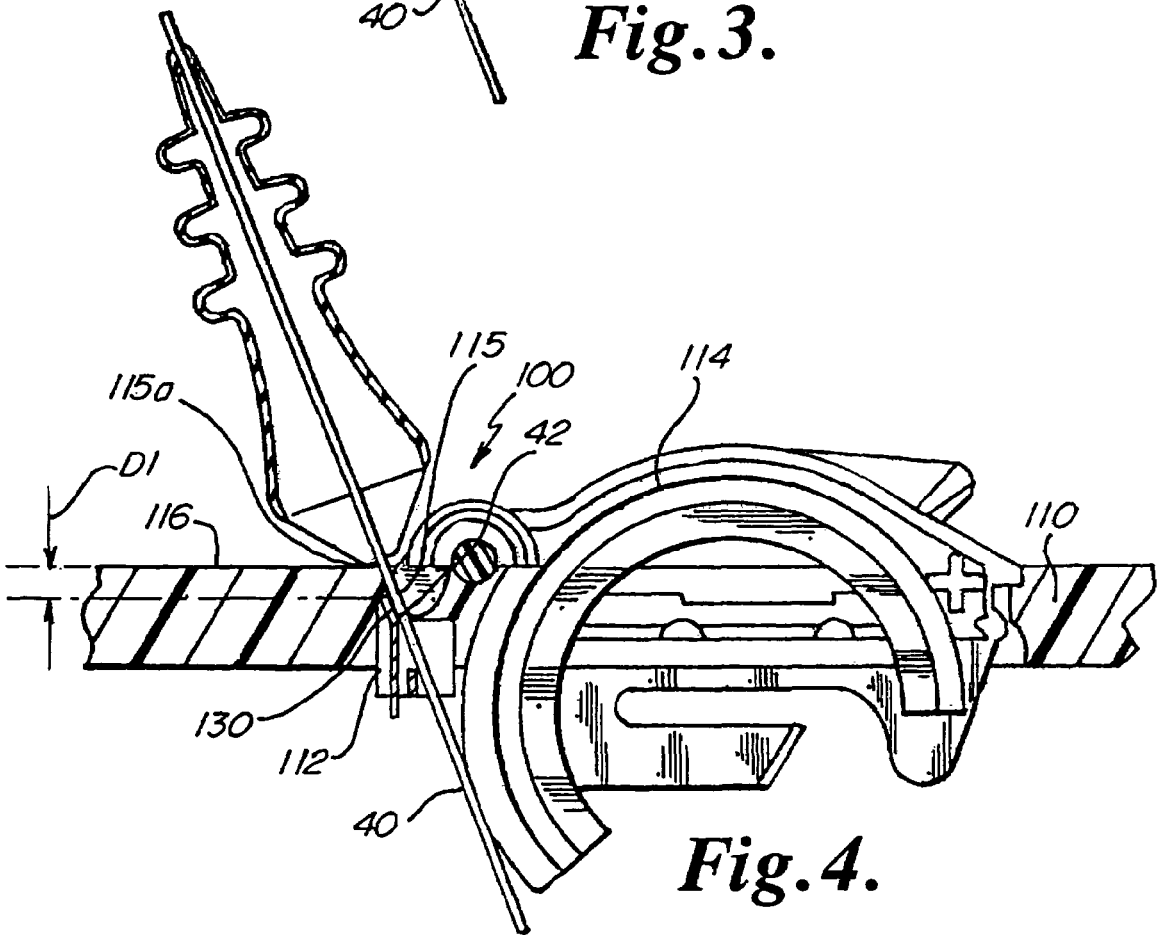
FIG. 4 is similar to FIG. 3, with the battery door closed.
Figure 5A:
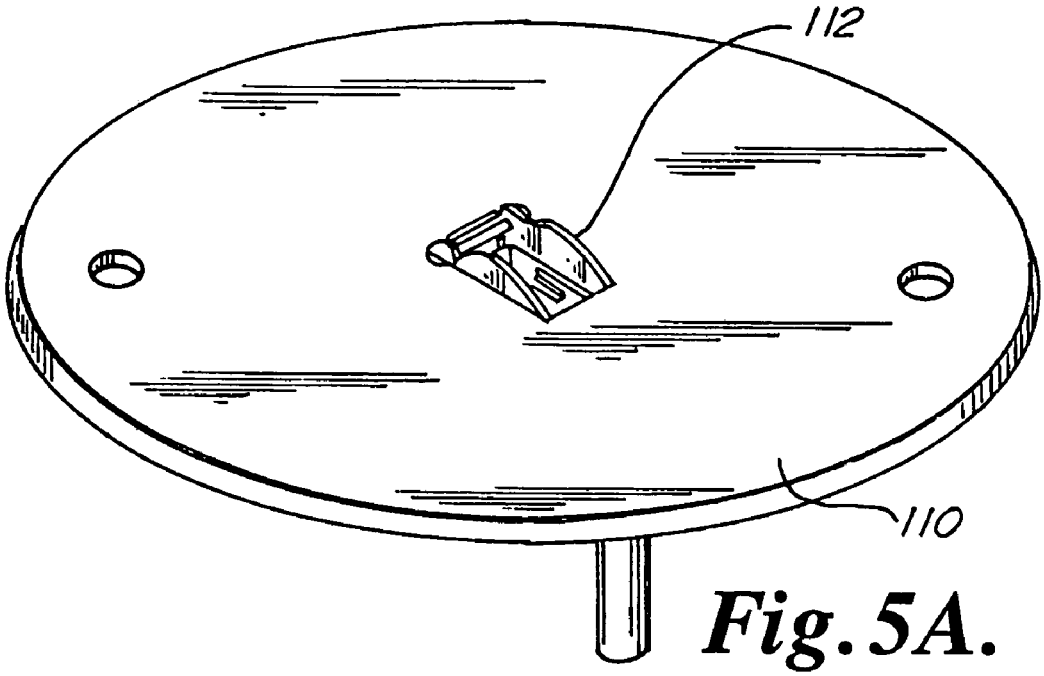
FIG. 5*a* is a top perspective view of a hearing aid housing faceplate without the programming system of the present invention inserted.
Figure 5B:
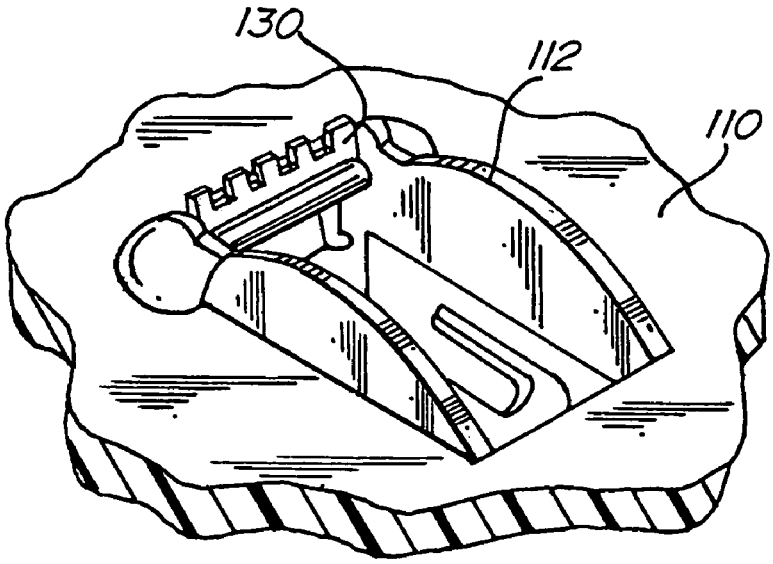
FIG. 5*b* is similar to FIG. 5*a*, with the programming system of the present invention inserted.
Figure 6:
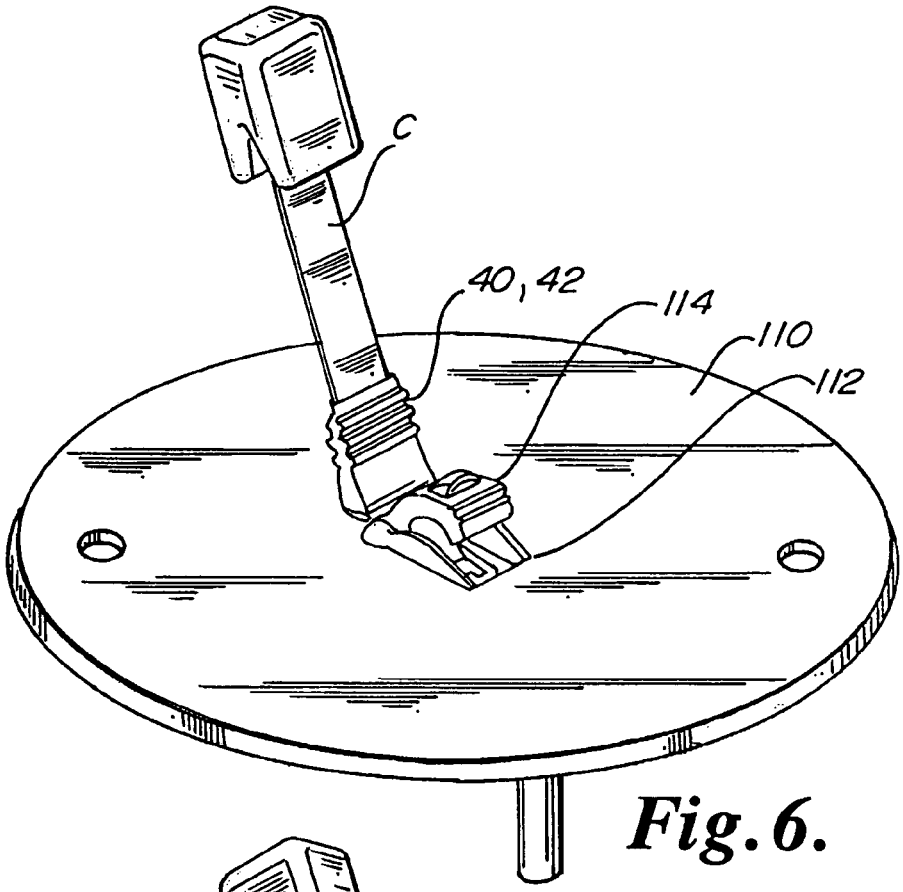
FIG. 6 is a top perspective view of a hearing aid housing faceplate with the present invention, showing a terminal strip about to be inserted.
Figure 7A:
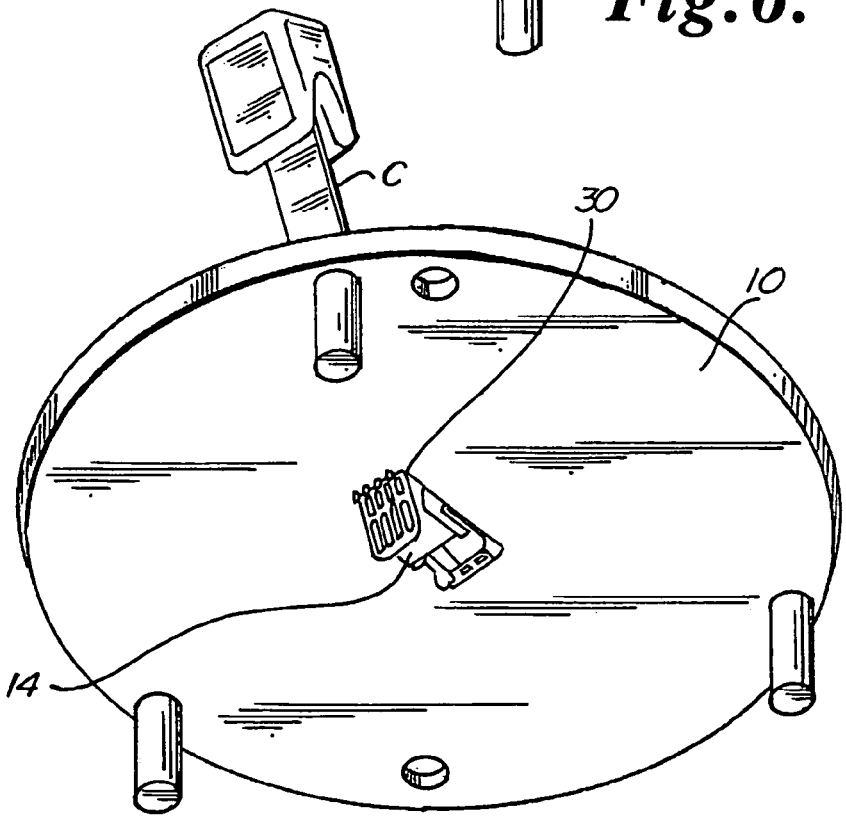
Fig. 7A. PRIOR ART
FIG. 7*a* is a bottom perspective view of a hearing housing faceplate of the prior art, showing a terminal strip about to be inserted.
Figure 7B:
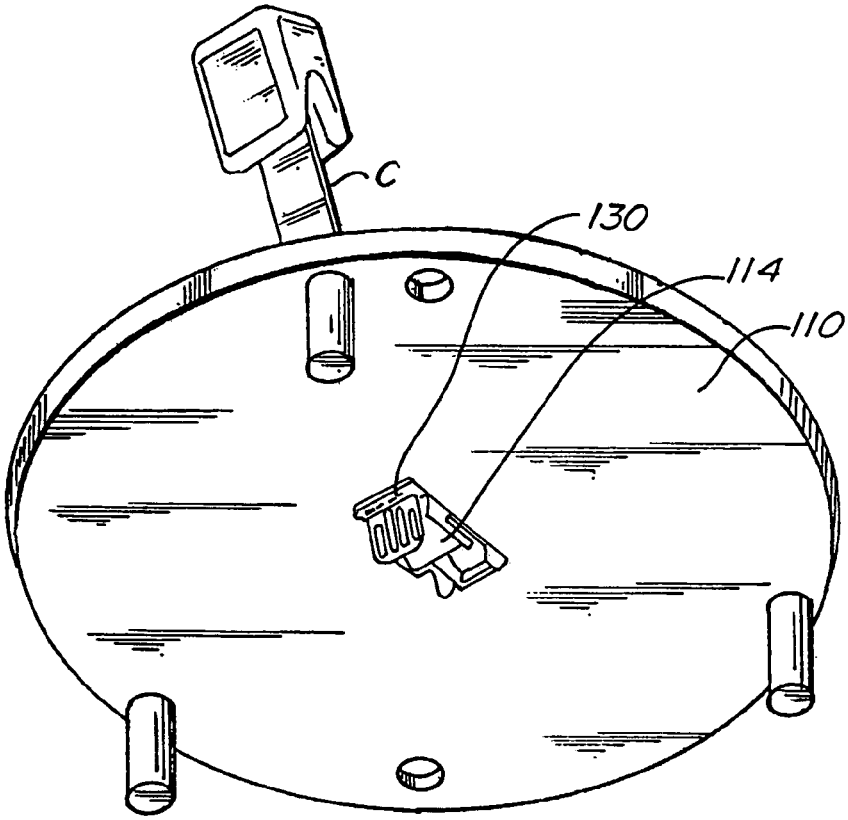
FIG. 7*b* is a bottom perspective view of a hearing aid housing faceplate with the present invention, showing a terminal strip about to be inserted.
Figure 8A:
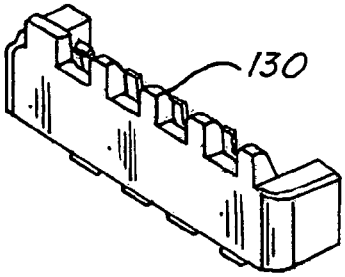
FIG. 8*a* is a left top perspective view of a connector of the present invention.
Figure 8B:
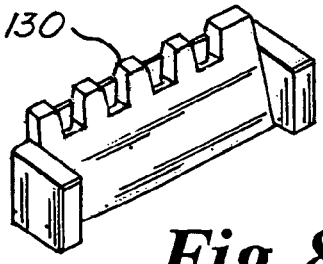
FIG. 8*b* is a right top perspective view, similar to FIG. 8*a*.
Figure 8C:
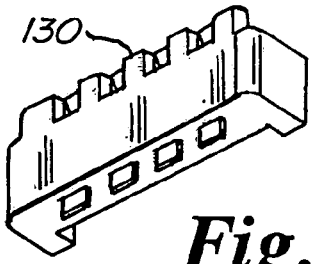
FIG. 8*c* is a bottom left perspective view of a connector of the present invention.
Figure 8D:
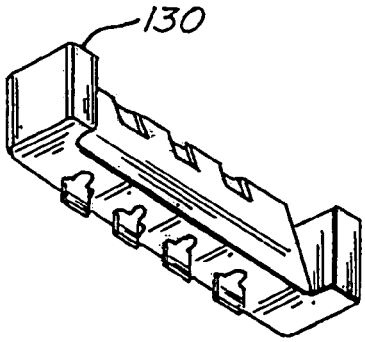
FIG. 8*d* is a bottom right perspective view, similar to FIG. 8*c*.

FIGS. 3-8*d* show a hearing aid programming system 100 of the present invention. The present invention 100 has a faceplate 110, which may be similar to or the same as the faceplate of the prior art. The faceplate 110 has an opening 112 for receiving a battery door 114. The faceplate 10 has an outside surface 116. The battery door 114 has an edge 118 defining a slot 120 with the opening 112 (FIG. 4). The battery door 114 is hingedly connected to the faceplate 110 by a hinge 122 and is movable between an open position (FIG. 3) and a closed position (FIG. 4). A plurality of programming terminals 130 are located in the opening 112 immediately adjacent the outside surface 116 of the faceplate (FIG. 4). A flexible programming strip 40 having a plurality of electrodes 42 and dimensioned to fit within the slot 20 may be inserted into the slot 20. The electrodes 42 then mate with the programming terminals 130. When the battery door 114 is closed (FIG. 4), the battery door in the hinge area 115 presses the electrodes 42 against the programming terminals 130. In particular, the protuberance 115*a* presses the electrodes 42 against the programming terminals 130. This provides a very secure connection that prevents the electrodes from becoming disconnected. Furthermore, because of the very small distance D1 between the point of contact of the flexible electrode strip 40 with the outside surface 116 of the faceplate 110 and the programming terminals 130, there is essentially no arm of movement in that portion of the flexible electrode strip 40 within the opening 112 below the outside surface 116 of the faceplate 110. Therefore, any movement of the cable C in which the flexible electrode strip is embedded will not cause the electrodes 42 to break contact with the programming terminals 130. Typically, although not limiting, the distance D1 is about 0.056 inches.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hearing aid programming system, comprising:

(a) a hearing aid housing;

(b) a faceplate attached to the hearing aid housing and having an opening for receiving a battery door and also having an outside surface;

(c) a plurality of programming terminals located in the opening immediately adjacent the outside surface of the faceplate, where the distance between the outside surface of the faceplate and the programming terminals is about 0.056 inches;

(d) a battery door located within the opening, one edge of the battery door defining with the opening a slot, the battery door having a hinge pivotally connected to the faceplate and the battery door being movable between an open position and a closed position;

(e) a flexible programming strip having a plurality of electrodes and dimensioned to fit within the slot, the plurality of electrodes mating with the plurality of programming terminals; and (f) the battery door in the closed position pressing the electrodes against the programming terminals near the hinge to make electrical contact with the electrodes.

2. The system of claim 1, wherein a protuberance on the battery door hinge presses the electrodes against the programming terminals.

3. A hearing aid programming system, comprising:

(a) a hearing aid housing;

(b) a faceplate attached to the hearing aid housing and having an opening for receiving a battery door and also having an outside surface;

(c) a plurality of programming terminals located in the opening immediately adjacent the outside surface of the faceplate;

(d) a battery door located within the opening, one edge of the battery door defining with the opening a slot, the battery door having a hinge pivotally connected to the faceplate and the battery door being movable between an open position and a closed position;

(e) a flexible programming strip having a plurality of electrodes and dimensioned to fit within the slot, the plurality of electrodes mating with the plurality of programming terminals; and (f) the battery door in the closed position pressing the electrodes against the programming terminals to make electrical contact therewith, wherein the battery door hinge presses the electrodes against the programming terminals near the hinge.

4. The system of claim 3 wherein the battery door hinge further comprises a protuberance that presses the electrodes against the programming terminal.

5. The system of claim 4, wherein the distance between the outside surface of the faceplate and the programming terminals is less than 0.142 inches.

6. The system of claim 5 wherein the distance between the outside surface of the faceplate and the programming terminals is about 0.056 inches.

7. A hearing aid programming system, comprising:

(a) a hearing aid housing;

(b) a faceplate attached to the hearing aid housing and having an opening for receiving a battery door and also having an outside surface;

(c) a plurality of programming terminals located in the opening immediately adjacent the outside surface of the faceplate;

(d) a battery door located within the opening, one edge of the battery door defining with the opening a slot, the battery door having a hinge pivotally connected to the faceplate and the battery door being movable between an open position and a closed position;

(e) a flexible programming strip having a plurality of electrodes and dimensioned to fit within the slot, the plurality of electrodes mating with the plurality of programming terminals; and (f) the battery door in the closed position pressing the electrodes against the programming terminals to make electrical contact therewith, wherein a protuberance on the battery door hinge presses the electrodes against the programming terminals near the hinge;

(g) wherein the distance between the outside surface of the faceplate and the programming terminals is less than 0.142 inches 8. The system of claim 7 wherein the distance between the outside surface of the faceplate and the programming terminals is about 0.056 inches.

* * * * *